US006212997B1

(12) United States Patent
McCollough et al.

(10) Patent No.: US 6,212,997 B1
(45) Date of Patent: Apr. 10, 2001

(54) RECIPROCATING FLUID PUMPS WITH CHROMIUM NITRIDE COATED COMPONENTS IN CONTACT WITH NON-METALLIC PACKING AND GASKET MATERIALS FOR INCREASED SEAL LIFE

(75) Inventors: Mark W. McCollough, Amherst; Joseph J. Karbowniczek, Elyria, both of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/243,517

(22) Filed: Feb. 1, 1999

(51) Int. Cl.[7] ..... F01B 31/10

(52) U.S. Cl. ..... 92/155; 92/168; 92/223; 417/554

(58) Field of Search ..... 92/155, 168, 222, 92/223; 417/554, 552

(56) References Cited

U.S. PATENT DOCUMENTS

| | | | | |
|---|---|---|---|---|
| 3,941,516 | * | 3/1976 | Soberg | 417/259 |
| 4,486,285 | | 12/1984 | Aubert et al. . | |
| 4,808,077 | | 2/1989 | Kan et al. . | |
| 4,871,297 | | 10/1989 | Boes et al. . | |
| 4,878,815 | | 11/1989 | Stachowiak . | |
| 4,943,486 | | 7/1990 | Uchiyama . | |
| 4,963,077 | | 10/1990 | Besic et al. . | |
| 5,160,537 | | 11/1992 | Terrat et al. . | |
| 5,431,229 | | 7/1995 | Christensen . | |
| 5,587,227 | | 12/1996 | Ooya . | |
| 5,671,656 | * | 9/1997 | Cyphers et al. | 92/172 |
| 5,672,386 | * | 9/1997 | Ooya | 427/250 |
| 5,700,094 | | 12/1997 | Dam et al. . | |

* cited by examiner

*Primary Examiner*—Edward K. Look
*Assistant Examiner*—Thomas E. Lazo
(74) *Attorney, Agent, or Firm*—Calfee, Halter & Griswold LLP

(57) ABSTRACT

Chromium nitride coating of machine components such as reciprocating pump plungers for continuous sliding contact with non-metallic packing and gasket materials greatly increases the performance life of fluid seals. In an air driven reciprocating constant pressure pump, exterior surfaces of the pump plunger are coated with chromium nitride to a thickness of seven to ten microns. The coating resists failure from repeated sliding contact against non-metallic packing and gasket materials for at least four million pump cycles, with no evidence of cracking or release of metallic particles which would embed in the packing or gasket material and score the plunger. In lower pressure pumps, interior walls of a housing against which a sliding gasket bears, when coated with chromium nitride, greatly increase the seal life of the sliding gasket.

19 Claims, 8 Drawing Sheets

RECIPROCATING FLUID PUMPS WITH CHROMIUM NITRIDE COATED COMPONENTS IN CONTACT WITH NON-METALLIC PACKING AND GASKET MATERIALS FOR INCREASED SEAL LIFE

FIELD OF THE INVENTION

The present invention pertains generally to thin film coating of materials including metal or steel machine components and, more particularly, to coating of metal or steel parts which are intended for assembly and moving contact with parts made of non-metallic or non-ferrous materials.

BACKGROUND OF THE INVENTION

Steel and metal products and machine components are commonly plated or coated for corrosion protection, hardness, friction reduction and appearance. Platings such as chromium, nickel, copper, gold, etc. are commonly applied by an electroplating dipping process. For close tolerance and wear surface applications, these processes are difficult to tightly control to achieve uniform coatings which have the desired physical properties such as hardness, durability and resistance to cracking.

Modern metal coating processes such as chemical vapor deposition (CVD) and physical vapor deposition (PVD) provide improved coating uniformity, strength and hardness. These types of metal coating processes are widely applied to cutting tools and machine components which bear heavy mechanical loads and are in moving contact with other steel or metal components. Metal coatings are applied to steel or metal parts to withstand contact with or cutting of other steel or metal parts. These types of coatings, having extreme hardness and strength, have to the inventors' knowledge not been used in applications where mechnical contact is made with softer non-metallic materials.

Machine components which are in moving contact with components or parts made of non-ferrous/non-metallic materials have also been plated, such as chrome plating of plunger and housing components of reciprocating pumps, which slide against packings made of leather, plastic, rubber or other materials. A common failure of this type of arrangement occurs when cracks form in the chromium plating layer. The cracks form due to volume contraction which occurs when the as-deposited chromium hydrides decompose to molecular hydrogen and chromium metal during post-plating bake-out. Post plating grinding can also produce foreign chrome particles which can damage a seal. Eventually small particles of the chromium layer imbed in the packings. The packings then act as a tool holder of the particles which cut into and score the plated component as it continues to slide against the packings, forming abrasions in the plated surface. The scored abrasions on the plated surface in turn damage the packings, ultimately causing the seal between the packings and the plated surface to fail. Also, as the packings are damaged, they are more likely to collect oxide particles, such as titanium dioxide, from fluid material such as paint being transferred through the pump. These particles can have hardness comparable to chrome and further contribute to scoring of the plunger. Failure of the seals in a reciprocating style pump causes loss of output pressure and loss of containment of the pumped fluid and contamination of other pump components.

In analyzing these type of seal failures, it is most intuitive to suspect the relatively softer non-metallic material, of which the packings are made, as the failing component. However, the inventors have discovered that the above described failure process starts with the failure of the plating or coating of the steel or metallic parts which bear against the packings. FIGS. 3–6 are micrographs of a chrome plated surface of a reciprocating pump plunger component designed for sliding/sealing contact with a non-metallic packing such as V-rings made of Teflon. In FIGS. 3 and 4, chrome particles are indicated at CP, and linear scores S are clearly seen running in the direction of reciprocation of the part past a seal. FIG. 5 shows an unused surface of a pump plunger chrome plated to prior art design specifications. Cracks CC are shown in the coating, along with chrome particles CP. FIG. 6 shows a plunger surface after 500 cycles of operation in sliding contact with a packing, exhibiting cracks CC, chrome particles CP within the cracks, and two score lines S.

FIG. 7 shows a mixture of particles P, including chromium and titanium dioxide, imbedded in a Teflon V-ring used as a packing in a reciprocating pump. Linear score marks S are visible in the glass fibers F embedded in the Teflon ring. FIGS. 8 and 9 show chromium particles CP embedded in a Teflon packing ring. And FIG. 10 shows a titanium dioxide particle P from paint trapped in a score S in a glass fiber in a V-ring of a pump packing. These micrographs support the inventive discovery that a source of seal failure in combined machine components of metallic and non-metallic materials is the metallic component such as the plating layer on a reciprocating plunger.

In testing, a reciprocating pump in which the plunger is chrome plated to design specifications and in accordance with quality controls, seal failures have occurred at as few as 100,000 pump cycles. The thickness of chrome plating, on the order of approximately 0.004–0.008 inches, requires substantial pre-grinding of the plunger stock to arrive at post-plating tolerances. A post plating grind is also required. Both grinding operations add significantly to manufacturing costs.

SUMMARY OF THE PRESENT INVENTION

The present invention overcomes these and other disadvantages of the prior art by providing chromium nitride coated machine components which are placed in moving contact with non-metallic components, for increased lifespan of the non-metallic components. In accordance with one particular application of the invention, there is provided a reciprocating pump which has a plunger which is actuated to linearly reciprocate within a housing and to bear against one or more non-metallic packing seals.

In accordance with one aspect of the invention, there is provided a reciprocating type fluid pump having a hydraulic section including a housing and a plunger driven to reciprocate at least partially within the housing and to pass through an opening in the housing, the housing having a fluid intake port and a fluid exit port, a ball check operatively associated with the fluid intake port, and a packing seal positioned about a periphery of the opening in the housing through which the plunger passes, the packing seal being made of a non-metallic material and dimensioned to extend into the opening in the housing through which the plunger passes so as to make contact with the plunger as the plunger passes through the opening as it reciprocates at least partially within the housing, and at least one additional seal between the plunger and the housing spaced from the opening in the housing, the plunger having an external surface area configured to bear against and make sliding contact with the packing seal about the periphery of the opening through which the plunger passes as it reciprocates at least partially within the housing, an internal passageway within the plunger which extends generally axially from one end of the plunger to an exit point spaced from the one end of the plunger, and a ball check operatively associated with the internal passageway of the plunger, the external surface of the plunger which contacts the packing seal being coated with chromium nitride, whereby the chromium nitride coating is in continuous contact and sliding with the packing seal, whereby a hydraulic seal is formed between the plunger and the packing seal.

These and other aspects of the invention are herein described in particular detail with reference to the accompanying Figures.

DETAILED DESCRIPTION OF PREFERRED AND ALTERNATE EMBODIMENTS

Figure 1A:
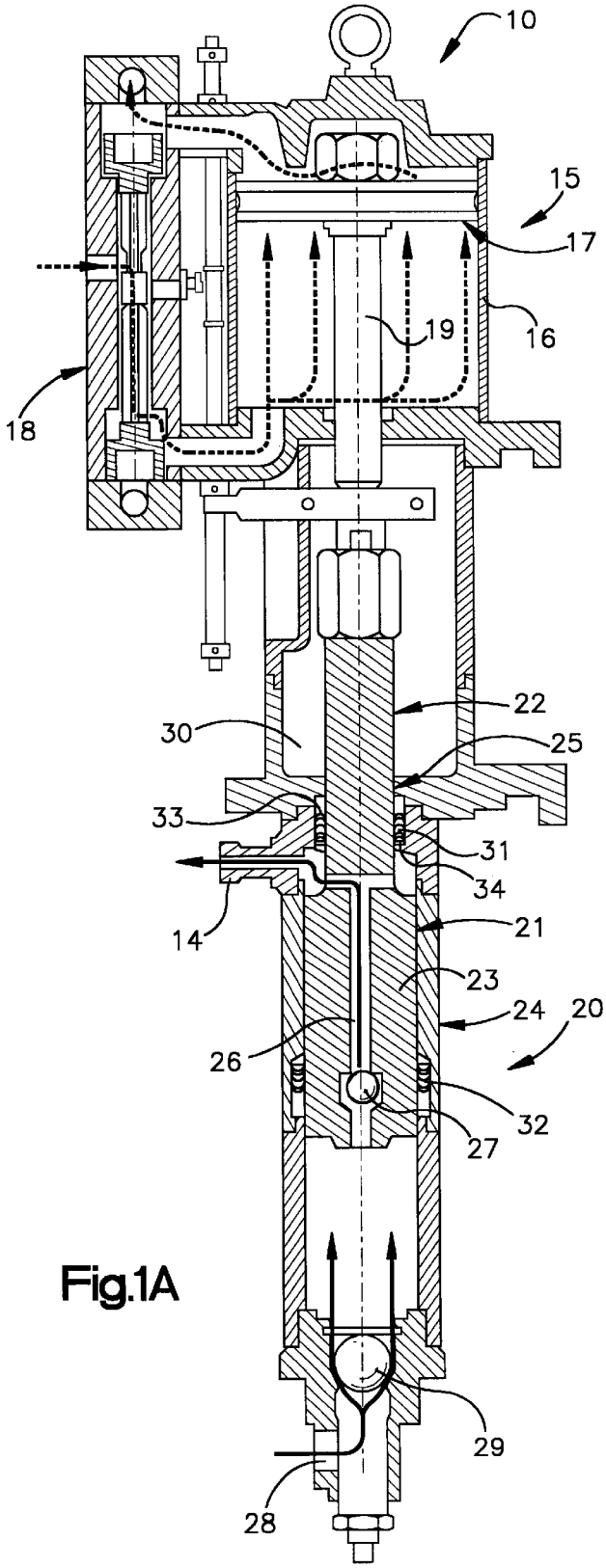
FIG. 1A is a cross-sectional view of one type of reciprocating pump which can be manufactured in accordance with the present invention, shown near the end of a siphon stroke of the pump.
Figure 1B:
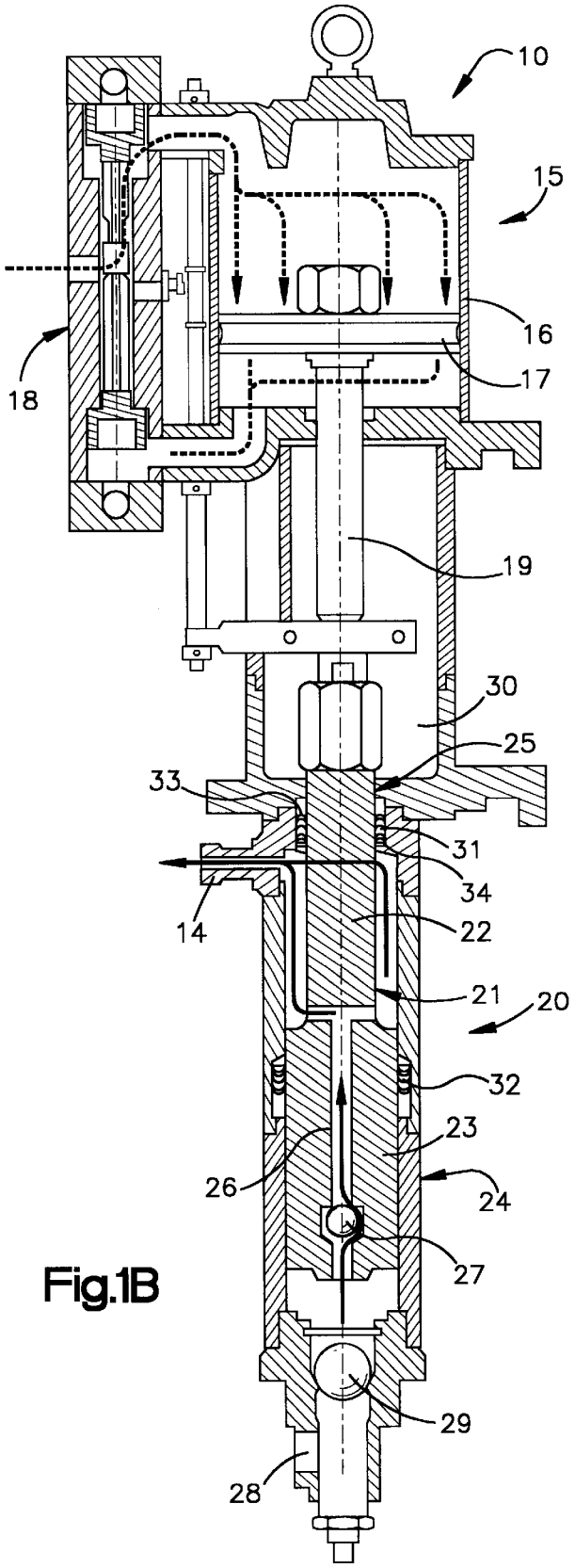
FIG. 1B is a cross-sectional view of the pump of FIG. 1A shown near the end of a pressure stroke.

As shown in FIGS. 1A and 1B, one type of machine in which the principles of the invention can be employed is a reciprocating fluid delivery pump, indicated generally at 10. The pump 10 includes an air motor section 15 and a hydraulic section 20. The air motor section 12 includes a cylinder 16 in which a piston 17 is mounted to reciprocate in response to air pressure introduced through an air valve, indicated generally at 18. The piston 17 is connected to a connecting rod 19 which passes through the cylinder 16, and is connected to a plunger 21. The plunger 21 includes an upper section 22 and a lower section 23. As used herein, the terms "upper" and "lower" are merely illustrative of one particular orientation of the described pump and are not limiting to other possible orientations of the pump or pump components, or otherwise limiting to the scope of the invention. The plunger 21 is mounted for linear reciprocation within a hydraulic housing. The upper section 22 of the plunger 21 passes through an opening 25 in the hydraulic housing 24 which leads into a solvent chamber 30, to reciprocate both within the housing 24 and within the solvent chamber 30, which is located between the air cylinder 16 and the housing 24. The lower section 23 of the plunger 21 remains within the housing 24 throughout the reciprocation cycle of the pump.

The lower section 23 of the plunger 21 includes an internal passageway or bore 26 which extends from a lower end of the section 23 to an upper end where it joins with the upper section 22. A pressure ball check 27 is mounted within the bore 26 near the lower end of the lower section 23. The housing 24 further includes a fluid intake port 28 in which a siphon ball check 29 is mounted, and a fluid exit port 14, which is the pressurized delivery point of the pump.

Upper packings 31, and lower packings 32, (also referred to herein as "seals" and "packing seals") are mounted within the walls of the housing 24, to form a seal against the outer diameters of the upper and lower sections 22, 23 of the plunger 21. The upper packings 31 prevent fluid from exiting the housing 24 through opening 25 during both the siphon and pressure strokes of the pump. The lower packings 32 form the siphon force which draws liquid into the housing during the siphon stroke of the pump shown in FIG. 1A, and force liquid through the plunger bore 26 during the pressure stroke of the pump shown in FIG. 1B, by preventing passage of fluid between the outer diameter of the lower section of the plunger and the interior surface of the walls of housing 24.

The packings 31 and 32 are, in one embodiment, formed of a plurality of rings 33 having a generally V-shaped cross-section with a chamfered edge on the inner diameter which bears against the outer diameter of the plunger sections. The rings are preferably made of any of the below listed non-metallic materials which , in accordance with the principles of the invention, are well-suited for continuous and repeated sliding contact with a chromium nitride coated machine component such as the described plunger. The non-metallic ring material may be selected from the representative group of: polyurethane; polyurethane with molybdenum disulfide; carboxylated nitrile; ethylene propylene (EPR or EPDM); polypropylene; nylon; neoprene; fluorocarbon; Buna-N (Nitrile); Kalrez; Polysulfide; styrene butadiene; ultra high molecular weight (UHMW) polyethylene; teflon, leather; and combinations of these materials, such as buna-N on cotton duck, teflon impregnated buna-N or nylon fabric.

A ring adapter 34 applies pressure to the rings 33 to bias the internal diameter against the plunger. A solvent such as a glycol such as polyether or polypropylene glycol, mixed aliphatic dimethyl esters, liquid anionic floculant, vitalizer oil or epoxidized soybean oil, is added to the solvent chamber 35 primarily to lubricate the upper packings 31. The lower packings 32 are lubricated by the fluid drawn into the hydraulic housing 24.

In order to dramatically increase the performance life of the seal formed by the packings 31 and 32, the outer diameter surfaces of the upper section 22 and lower section 23 of the plunger 21 are coated with chromium nitride (CrN) by a physical vapor deposition (PVD) process. The coating is applied to thickness in a preferred approximate range of 7 to 10 microns, and the surfaces to be coated are pre-ground to this extent. Because this dimension is substantially less than that required for conventional chrome plating, the invention provides significant manufacturing cost savings. No post-coating grinding is required, which also reduces manufacturing costs. Prior to coating, the plunger is heat treated at approximately 1150° F. for a period of approximately four hours and allowed to air cool.

The repeated sliding contact of the chromium nitride coated plunger against the packings 31 and 32 does not cause any cracks in the coating, or coating particles to leave the plunger surface and lodge in the packings. In testing, pumps with chromium nitride coated plungers have performed up to four million cycles (one cycle being defined as the complete travel of the plunger through the pressure stroke and siphon stroke—(add approx. length of plunger and extent of travel, e.g. 6 inches) without any abrasion of the of the plunger surfaces detectable at 5000× magnification.

Figure 2:
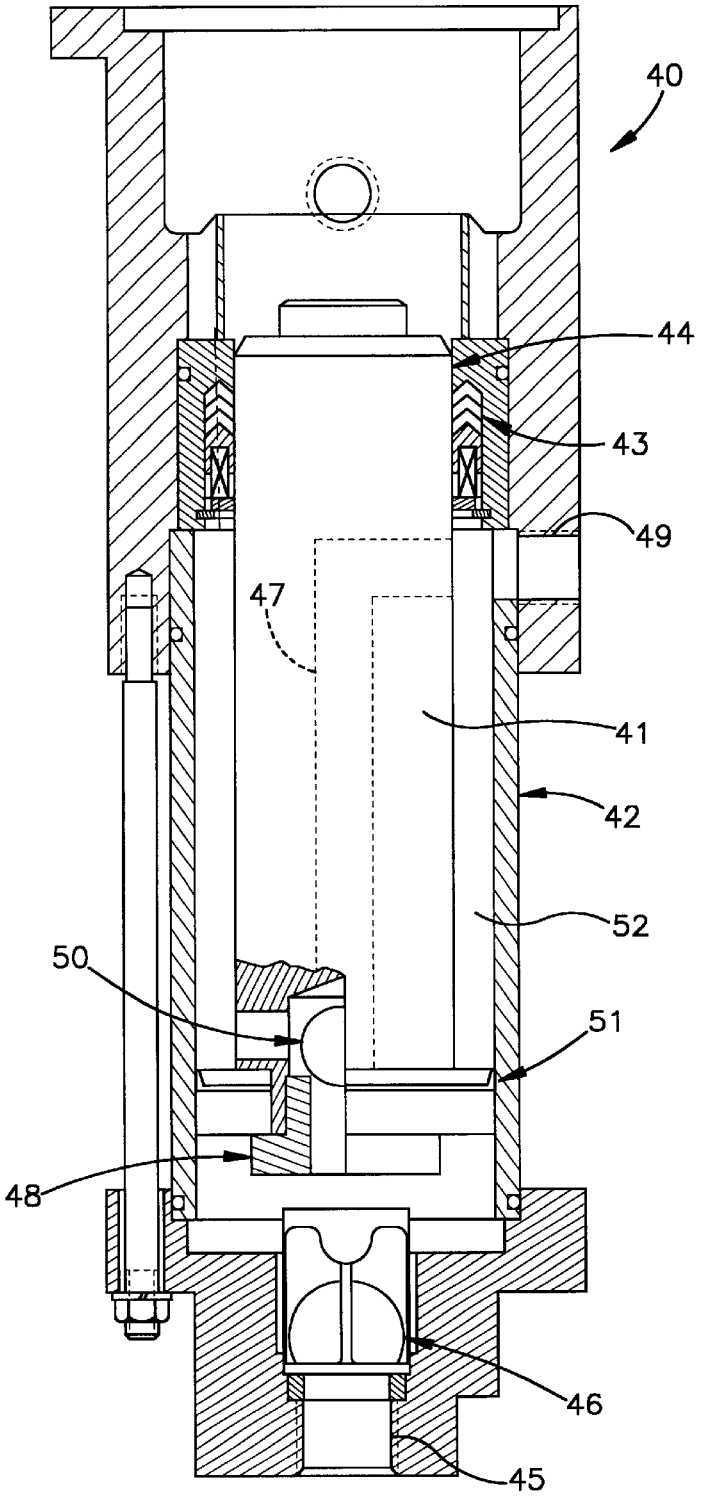
FIG. 2 is a cross-sectional view of another type of reciprocating pump which can be manufactured in accordance with the present invention.
Figure 3:
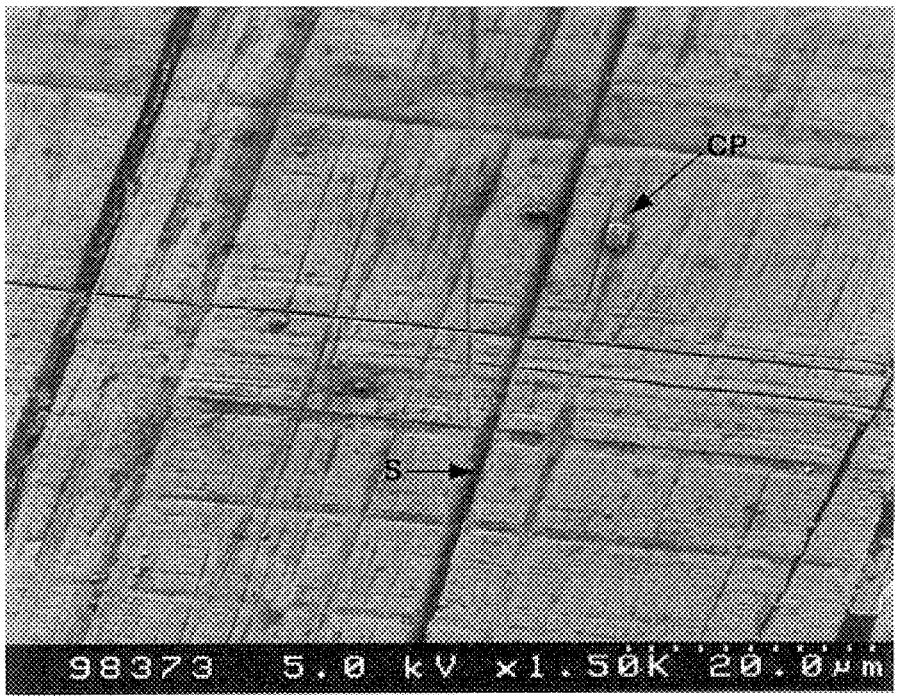
FIGS. 3–6 are micrographs of a chrome plated surface of a reciprocating fluid pump plunger component.
Figure 4:
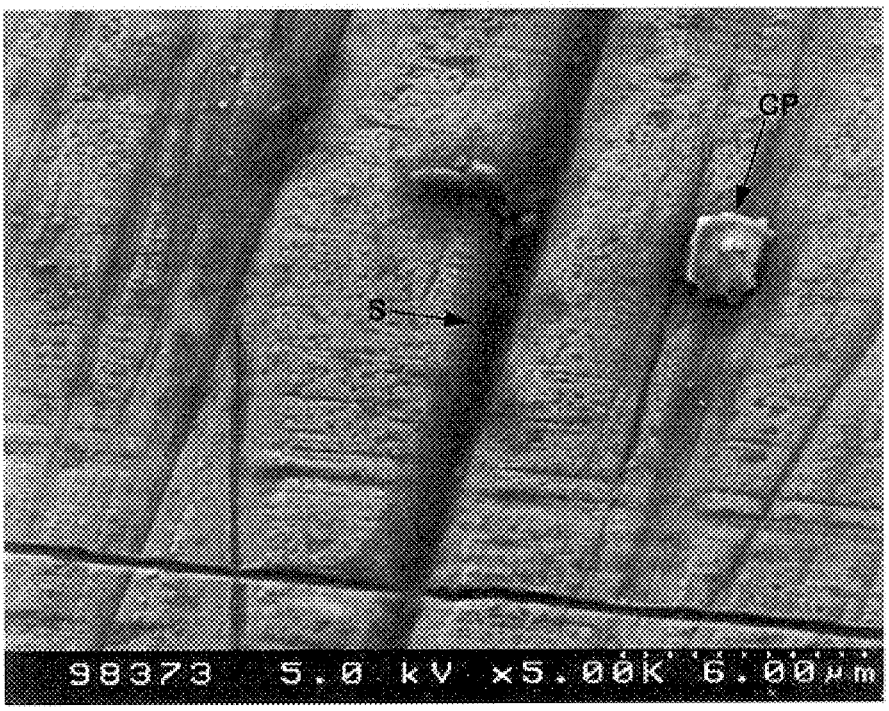
Figure 5:
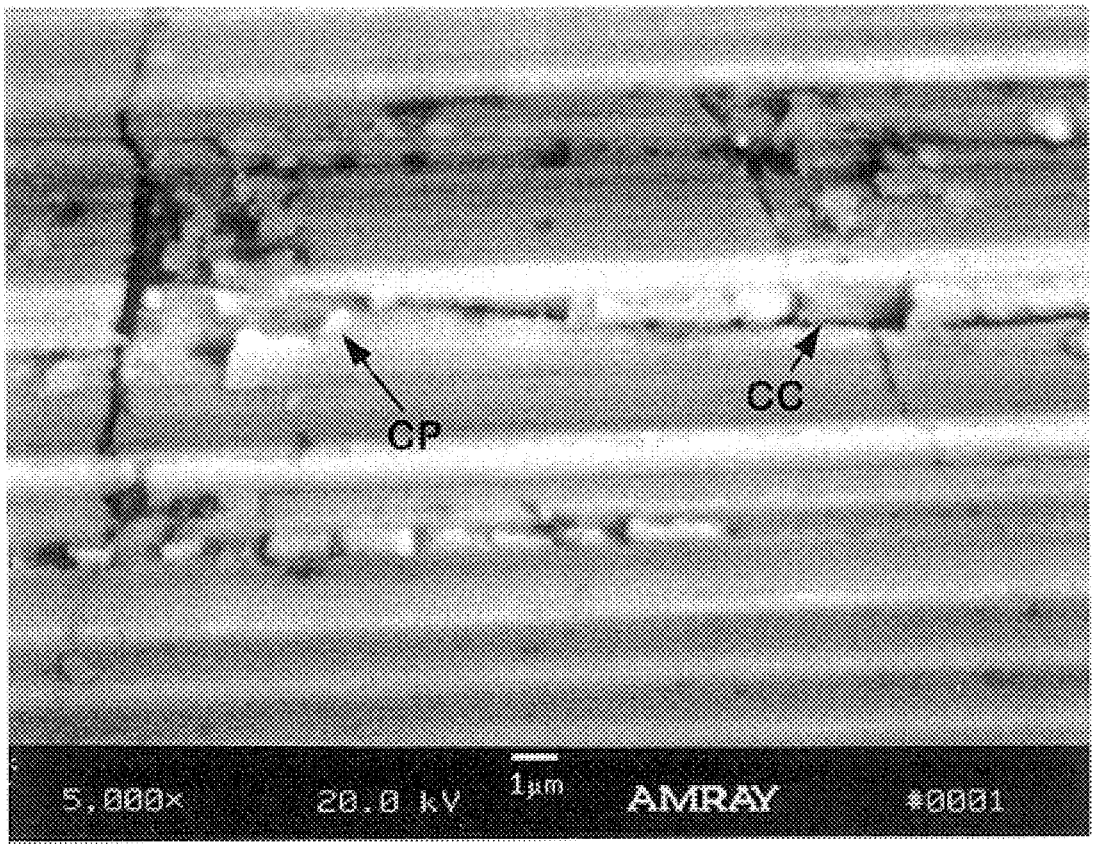
Figure 6:
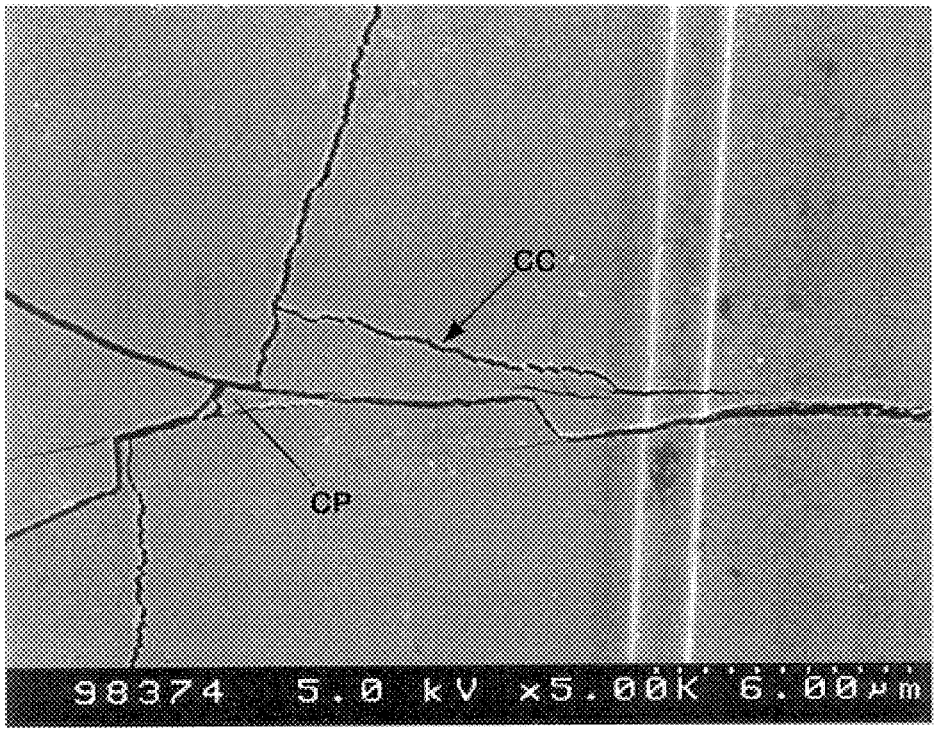
Figure 7:
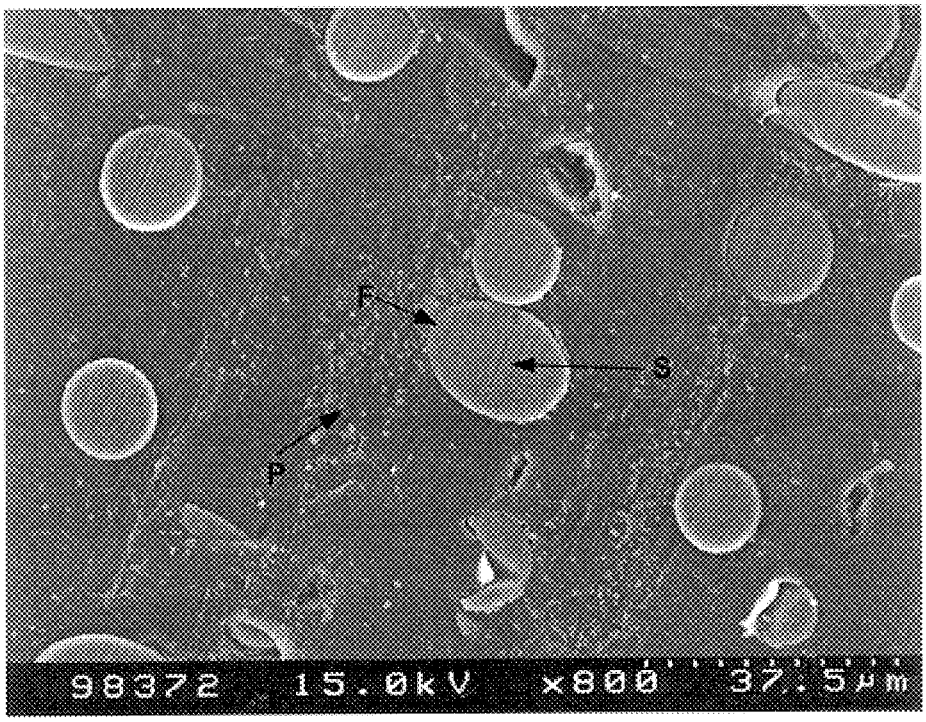
FIGS. 7–10 are micrographs of Teflon V-rings used as packings in reciprocating fluid pumps.
Figure 8:
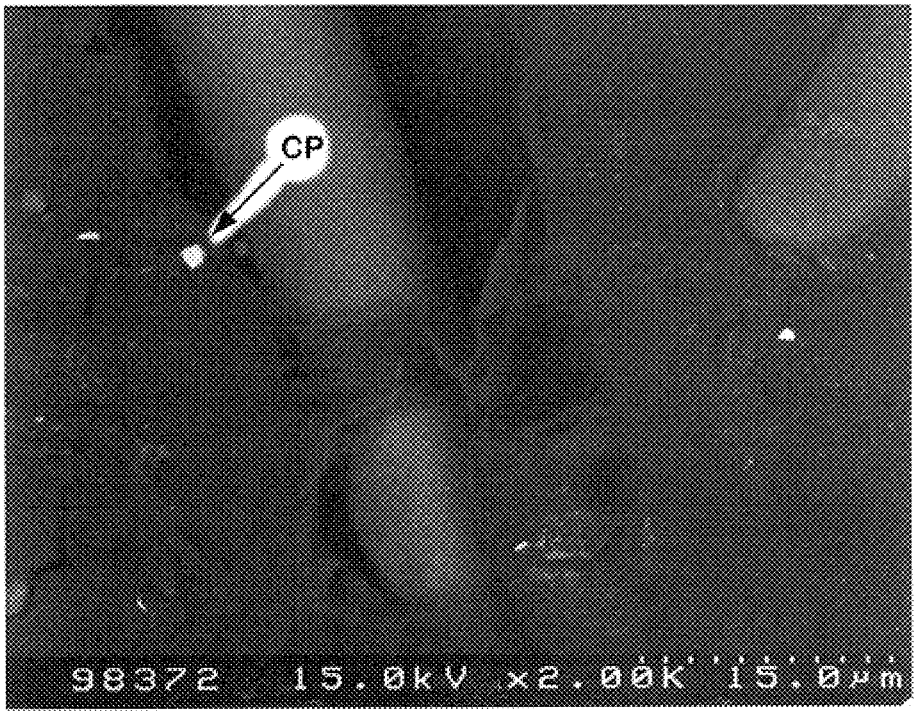
Figure 9:
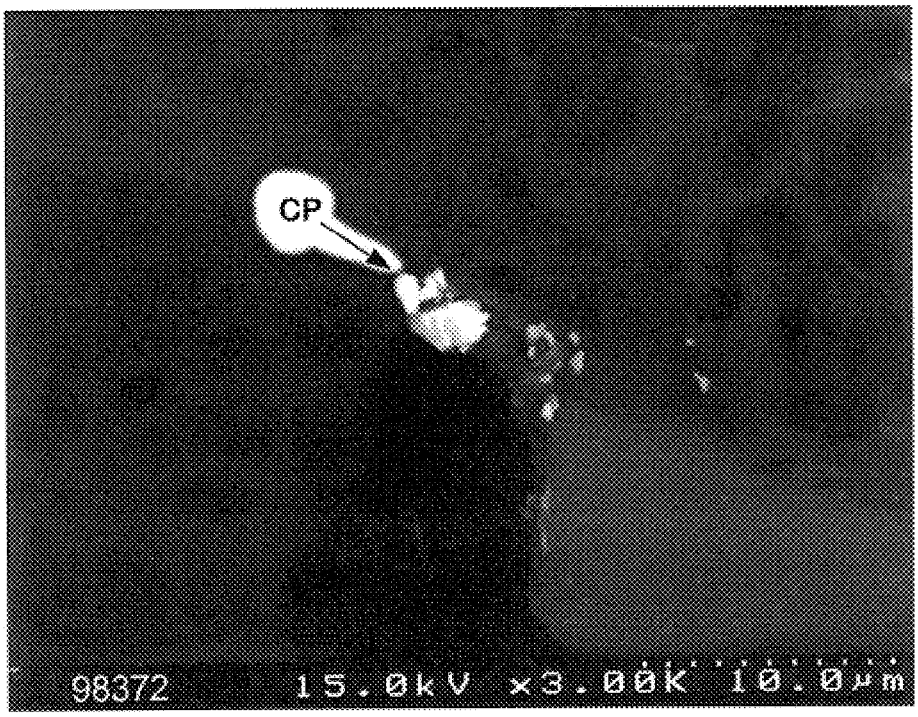
Figure 10:
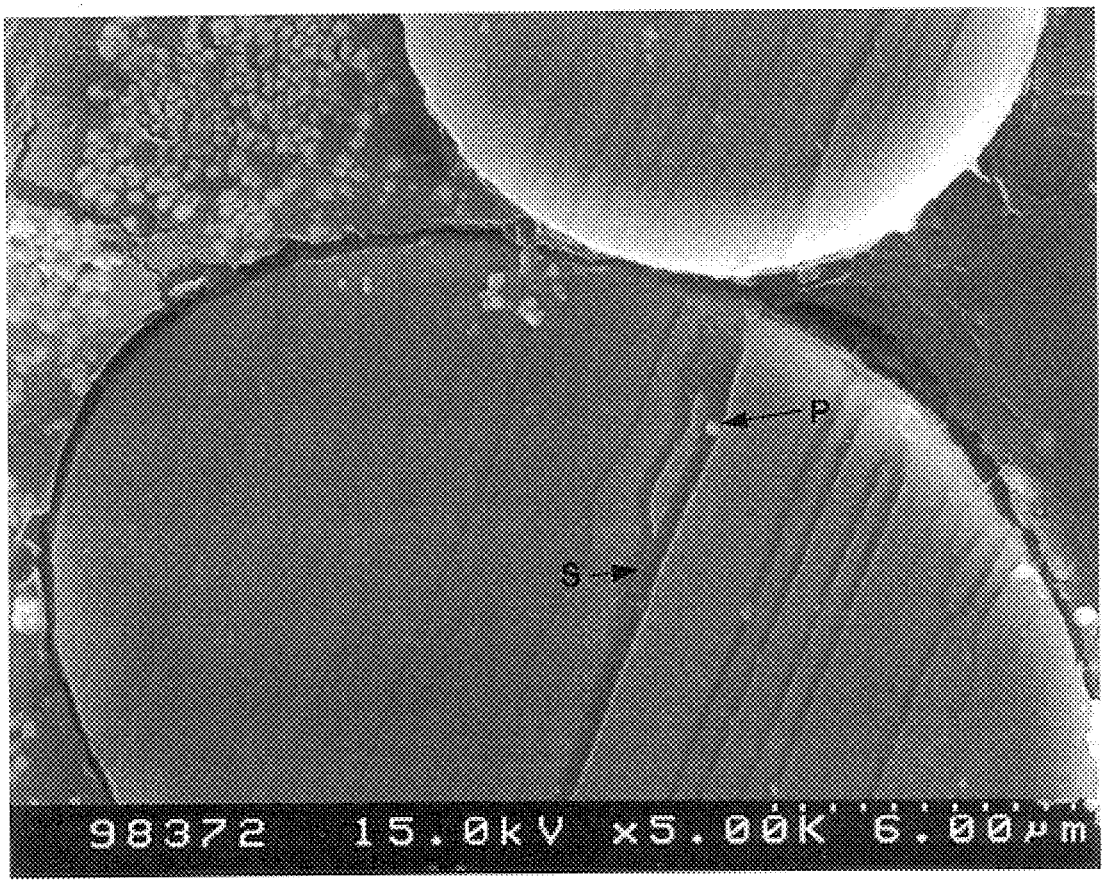

FIG. 2 illustrates the hydraulic section, indicated generally at 40, of another embodiment of a reciprocating pump constructed in accordance with the invention. In this type of pump, the plunger 41 has a single section with a constant outer diameter, and reciprocates within the hydraulic housing 42 past a single packing or seal 43 near an opening 44 of the housing 42. Fluid is drawn into the housing through an inlet 45 which includes a siphon ball check 46, which prevents the flow of liquid out of the inlet during the pressure stroke of the plunger. The plunger 41 includes an internal bore 47 which extends from a distal end 48 of the plunger, to a point approximately aligned with an outlet port 49 of the housing 42. A ball check 50 is incorporated into the internal bore 47 of the plunger near the distal end 48 to prevent flow of fluid through the plunger during the pressure stroke of the plunger. A sliding gasket 51 (also referred to herein as a "sliding seal"), such as in the form of a U-cup made of polyurethane or other suitable material, reinforced by opposing back-up washers, is mounted upon the plunger 41 near distal end 48, and in contact with the internal walls of the housing 42, to prevent fluid from entering the open area 52 between the plunger 41 and the housing 42. Alternatively, one or more rings having a V-shaped cross-section, similar to the packings described with reference to FIGS. 1A and 1B, may be used as the sliding gasket 51 attached to the plunger 41.

In this embodiment, the internal walls of the housing are coated with chromium nitride, to similar thickness' as described above, to dramatically increase the performance life of the seal formed by the sliding gasket 51. Repeated sliding contact of the gasket 51 against the interior walls of the housing 42, for up to four million cycles in testing by the inventors, does not cause any cracking or failure of the chromium nitride coating, or production of coating or metallic particles which would become lodged within the gasket 51 and score the housing walls.

In this type of pump also, it has been found through testing that the described chromium nitride coating of the outer surface of the plunger 41 has greatly improved the performance life of the seal formed by packing 43, due to the fact that the chromium nitride coating does not crack after application or during the repeated sliding contact with the packing 43, and therefore does not produce metal particles which become lodged in the packings and score the plunger. As with the previously described pump, the pump of FIG. 2 has been tested up to four million cycles without an seal failure, and without producing any detectable scoring of the plunger. Other types of coatings which can be applied by physical vapor deposition and which provide similar performance enhancements to the described pumps include titanium nitride (TiN), titanium aluminum nitride (TiAIN), aluminum titanium nitride (AlTiN), titanium carbon nitride (TiCN), and zirconium nitride (ZrN).

The invention thus provides dramatically improved machine performance in cases where a dynamic seal is formed between a metallic surface and a non-metallic surface, with manufacturing cost savings over traditional plating processes.

What is claimed as the invention is:

1. A reciprocating type fluid pump having a hydraulic section including a housing and a plunger driven to reciprocate at least partially within the housing and to pass through an opening in the housing, the housing having a fluid intake port and a fluid exit port, a packing seal positioned about a periphery of the opening in the housing through which the plunger passes, the packing seal being made of a non-metallic material and contacting the plunger as it passes through the opening as it reciprocates at least partially within the housing, the plunger having an external surface area configured to bear against and make sliding contact with the packing seal about the periphery of the opening through which the plunger passes as it reciprocates at least partially within the housing, the external surface of the plunger, which contacts the packing seal, being coated with chromium nitride, the plunger being driven to reciprocate in the housing to draw fluid through the fluid intake port and pump fluid out the fluid exit port.

2. The reciprocating type fluid pump of claim 1 wherein the chromium nitride coating is in continuous and sliding contact with the packing seal, whereby a hydraulic seal is formed between the plunger and the packing seal.

3. The reciprocating fluid type pump of claim 1 further comprising a ball check operatively associated with the fluid intake port, and a ball check operatively associated with the fluid exit port.

4. The reciprocating type fluid pump of claim 1 further comprising at least one additional seal between the plunger and the housing.

5. The reciprocating type fluid pump of claim 4 wherein the at least one additional seal between the plunger and the housing is a packing seal incorporated into a wall of the housing, the packing seal dimensioned to contact the plunger, and a portion of the plunger dimensioned to fit within the housing and to make contact with the at least one additional packing seal, the portion of the plunger dimensioned to fit within the housing being coated with chromium nitride, and the at least one additional packing seal being made of a non-metallic material.

6. The reciprocating type fluid pump of claim 5 wherein a portion of the plunger is dimensioned to fit within the housing and make contact with the at least one additional packing seal is larger than a portion of the plunger which extends through the opening in the housing and makes contact with the packing seal about the periphery of the opening in the housing.

7. The reciprocating type fluid pump of claim 4 wherein the at least one additional seal between the plunger and the housing is a sliding gasket which extends from the plunger to internal surfaces of the housing which prevents fluid which enters the housing.

8. The reciprocating type fluid pump of claim 7 wherein internal surfaces of the housing are coated with chromium nitride.

9. The reciprocating type fluid pump of claim 1 wherein the plunger further comprises an internal passageway which extends generally axially through the plunger, and a ball check operatively associated with the internal passageway.

10. The reciprocating type fluid pump of claim 9 wherein the internal passageway in the plunger extends substantially through a portion of the plunger dimensioned to fit within the housing, and does not extend substantially through a portion of the plunger which extends through the opening in the housing.

11. The reciprocating type fluid pump of claim 1 wherein the plunger is generally cylindrical and the external surface of the plunger which is coated with chromium nitride and which is in contact with the packing seal about the periphery of the opening in the housing, has a generally constant diameter.

12. The reciprocating type fluid pump of claim 1 wherein the packing seal is made of a material selected from the group of polyurethane; polyurethane with molybdenum disulfide; carboxylated nitrile; ethylene propylene (EPR or EPDM); polypropylene; nylon; neoprene; fluorocarbon;

Buna-N (Nitrile); Kalrez; Polysulfide; styrene butadiene; ultra high molecular weight (UHMW) polyethylene; teflon, and leather.

13. In a fluid pump having a plunger which reciprocates at least partially within a hydraulic housing, the hydraulic housing having a fluid intake and a fluid outlet, an opening in the housing through which a portion of the plunger passes as it reciprocates within the housing, an interior surface of the housing being coated with chromium nitride, and a non-metallic sliding seal between the plunger and the interior surface of the housing coated with chromium nitride, the sliding seal in sliding contact with the interior surface of the housing as the plunger reciprocates, whereby the pump is operative to draw fluid into the housing through an intake port, and to force fluid out of the housing through an exit port.

14. In the fluid pump of claim 13, wherein the sliding seal is a non-metallic U-cup attached to the plunger to extend generally radially from the plunger to the interior surface of the housing.

15. In the fluid pump of claim 13, a stationary packing seal associated with the opening in the housing through which the plunger passes, the stationary packing seal being made of a non-metallic material, and a portion of the plunger, which contacts the stationary packing seal, coated with chromium nitride.

16. In the fluid pump of claim 13, wherein the seal between the plunger and the interior surface of the housing is a non-metallic packing incorporated into the interior walls of the housing, and the portion of the plunger within the housing is coated with chromium nitride and in continuous contact with the non-metallic packing in the interior walls of the housing.

17. In the fluid pump of claim 13, the plunger having an internal fluid passageway and a ball check operatively associated with the internal fluid passageway.

18. In the fluid pump of claim 13 wherein the sliding seal and stationary packing seal are made of one or more non-metallic materials selected from the group of polyurethane; polyurethane with molybdenum disulfide; carboxylated nitrile; ethylene propylene (EPR or EPDM); polypropylene; nylon; neoprene; fluorocarbon; Buna-N (Nitrile); Kalrez; Polysulfide; styrene butadiene; ultra high molecular weight (UHMW) polyethylene; teflon, and leather.

19. In a fluid pump having a plunger which reciprocates at least partially within a hydraulic housing, with an outer surface of the piston being in direct sliding contact with a non-metallic seal, the improvement comprising:

said plunger surface that makes sliding contact with said seal being coated with chromium nitride.

* * * * *